US007319767B2

(12) United States Patent
Fidlin et al.

(10) Patent No.: US 7,319,767 B2
(45) Date of Patent: Jan. 15, 2008

(54) LINE ARRAY ELECTROACOUSTICAL TRANSDUCING

(75) Inventors: Paul Fidlin, Wayland, MA (US); Clifford A. Henricksen, Framingham, MA (US); Kenneth Dylan Jacob, Framingham, MA (US); Hilmar Lehnert, Framingham, MA (US); Peter C. Santoro, Shirley, MA (US)

(73) Assignee: Bose Corporation, Framingham, MA (US)

( * ) Notice: Subject to any disclaimer, the term of this patent is extended or adjusted under 35 U.S.C. 154(b) by 616 days.

(21) Appl. No.: 10/610,466

(22) Filed: Jun. 30, 2003

(65) Prior Publication Data

US 2004/0264716 A1 Dec. 30, 2004

(51) Int. Cl.
*H04R 25/00* (2006.01)
*H04R 9/06* (2006.01)

(52) U.S. Cl. ..... 381/182; 381/334; 381/335

(58) Field of Classification Search ..... 181/144, 181/145, 189, 190, 198, 199; 381/87, 182, 381/332, 334, 335, 386, 394, 395, 161
See application file for complete search history.

(56) References Cited

U.S. PATENT DOCUMENTS

| | | | | |
|---|---|---|---|---|
| 3,052,758 | A * | 9/1962 | Berry | 381/120 |
| 3,124,181 | A | 3/1964 | Pawlowski | |
| 3,299,206 | A | 1/1967 | Klepper | |
| 4,031,318 | A | 6/1977 | Pitre | |
| 4,042,778 | A | 8/1977 | Clinton | |
| 4,267,405 | A | 5/1981 | Russell | |
| 4,797,633 | A | 1/1989 | Humphrey | |
| 4,940,108 | A | 7/1990 | Selby | |
| 5,042,070 | A | 8/1991 | Linna et al. | |
| 5,309,518 | A | 5/1994 | Icker et al. | |
| 5,588,063 | A | 12/1996 | Edger | |
| 5,802,190 | A * | 9/1998 | Ferren | 381/386 |
| 5,852,545 | A | 12/1998 | Pan-Ratzlaff | |
| 5,917,923 | A | 6/1999 | Caron | |
| 6,101,261 | A | 8/2000 | Brown et al. | |
| 6,215,881 | B1 | 4/2001 | Azima et al. | |
| 6,385,322 | B1 | 5/2002 | Mietling | |
| 6,394,223 | B1 | 5/2002 | Lehman | |
| 6,556,684 | B1 | 4/2003 | Macey | |
| 2001/0029616 | A1 | 10/2001 | Jin | |
| 2003/0174855 | A1 | 9/2003 | Hawkins et al. | |
| 2004/0096074 | A1 | 5/2004 | Bontempi et al. | |

FOREIGN PATENT DOCUMENTS

| | | |
|---|---|---|
| EP | 0 593 191 | 4/1994 |

(Continued)

OTHER PUBLICATIONS

Eargle, J. et al. "Historical Perspective and Technology Overview of Loudspeakers for Sound Reinforcements," J. Audio Eng. Soc., vol. 52, No. 4, 2004 (Apr.).

(Continued)

*Primary Examiner*—Brian Ensey
(74) *Attorney, Agent, or Firm*—Fish & Richardson P.C.

(57) ABSTRACT

A line array electroacoustical transducing system includes at least first and second line arrays detachably secured in electrical and mechanical coupling relationships. The assembly may be detachably secured to a base having an amplifier in electrical and mechanical coupling relationships.

36 Claims, 15 Drawing Sheets

FOREIGN PATENT DOCUMENTS

| | | |
|---|---|---|
| EP | 0 791 279 | 2/1999 |
| EP | 1 199 907 | 4/2002 |
| EP | 1 494 502 | 1/2005 |
| GB | 1 187 462 | 4/1970 |
| JP | 06307107 | 1/1994 |
| JP | 06225379 | 12/1994 |
| JP | 11 243592 | 9/1999 |
| WO | WO96/14723 | 5/1996 |

OTHER PUBLICATIONS

Hardcopy printout of website http://www.eaw.com.
Hardcopy printout of website http://www.abtec.demon.co.uk.
"Manufacturer's Showcase", Stereophile, Oct. 2000, p. 254 (advertisement).
Hardcopy printout of website http://www.nearfieldacoustics.com.
Hardcopy printout of website http://www.duran-audio.com.
Hardcopy printout of website http://www.audiotechnology.se.
Hardcopy printout of website http://www.omnya.com.
Briggs, G.A. (Ed. Cook, Jr., R.E.) *Loudspeakers*, pp. 313-314, (c)May 1948.
Augspruger, G.L., "The Colinear Array—a Two-Way Loudspeaker System" (c)1970.
Smith, David L., "Discrete-Element Line Arrays—Their Modeling and Optimization", J. Audio Eng. Soc., vol. 45, No. 11, Nov. 1997, pp. 949-964.
Audio Reviews, "The Nearfield Acoustics PipeDreams: Ears Wide Open", The Sound, Issue 121, pp. 101-109.
Jordan, E.J., "Loudspeaker Enclosure Design", Wireless World, Jan. 1956, pp. 8-14; 75-79.
Jordan, E.J., "Multiple-Array Loudspeaker System", Wireless World, Mar. 1971, pp. 132-134.
Meyer, David G., "Multiple-Beam, Electronically Steered Line-Source Arrays for Sound-Reinforcement Applications," J. Audio Eng. Soc., vol. 38, No. 4, Apr. 1990, pp. 237-491.
Augspurger, G.L., et al. "An Improved Colinear Array".
Pawlowski, R. J., "The Line Radiator," Audio, Jul. 1961, pp. 19-21.

* cited by examiner

LINE ARRAY ELECTROACOUSTICAL TRANSDUCING

TECHNICAL FIELD

The present invention relates to a line array electroacoustical transducing and more particularly to a line array having a plurality of detachbly secured segments.

BACKGROUND OF THE INVENTION

A typical line array loudspeaker system comprises a plurality of vertically aligned loudspeaker drivers in a cabinet.

SUMMARY OF THE INVENTION

According to the invention, a line array electroacoustical transducing system comprises at least first and second line arrays detachably secured in electrical and mechanical interconnecting relationships. The assembly may include an amplifier having an input for receiving audio electrical input signals and an output electrically coupled to said at least two line arrays. The amplifier may have a mechanical support that supports the interconnected at least first and second line arrays with a mating connector detachably secured to a mating connector of an adjacent line array that establishes mechanical and electrical coupling between the amplifier and the line array. The mating connectors may be constructed and arranged for self alignment when the at least first and second line arrays and amplifier are assembled. There may be a locking mechanism to secure the assembly. The amplifier may have signal processing means for processing signals delivered to its input. The signal processing means may comprise one or more of crossover filters, equalization circuitry, voltage limiting circuitry, dynamic range processing circuitry, dynamic equalization circuitry, volume circuitry and noise gating. The signal processor may comprise preset processing parameters selectable by a user.

It is an important object of the invention to provide an improved line array electroacoustical transducing system.

Other features, objects and advantages will become apparent from the following detailed description when read in connection with the accompanying drawing in which:

DETAILED DESCRIPTION

Figure 1:
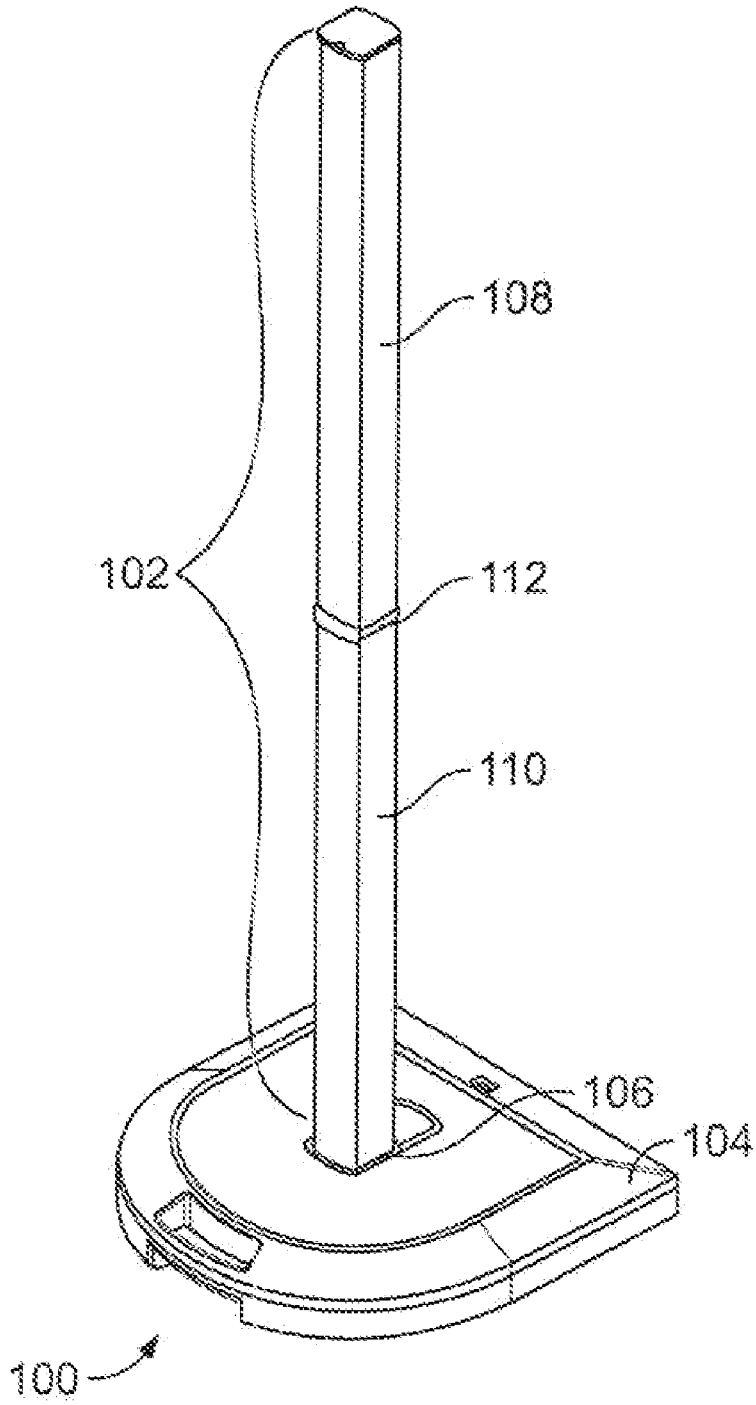
FIG. 1 depicts one embodiment of a loudspeaker system in accordance with the present invention.

In FIG. 1, one embodiment of a portable loudspeaker system 100 is depicted comprising a line array assembly 102 and an amplifier 104. Amplifier 104 may serve as a base mechanically supporting line array assembly 102 at connection 106. Electrical connections between the line array and the amplifier may be disposed within connection 106. In one embodiment, line array assembly 102 may be comprised of two line arrays 108 and 110. In other embodiments, line array 102 may comprise a single line array, or it may comprise more than two line arrays. Line array 108 may connect with line array 110 mechanically and electrically at connection 112. Line arrays 108 and 110 and amplifier 104 may be transported separately and assembled prior to use.

Figure 2:
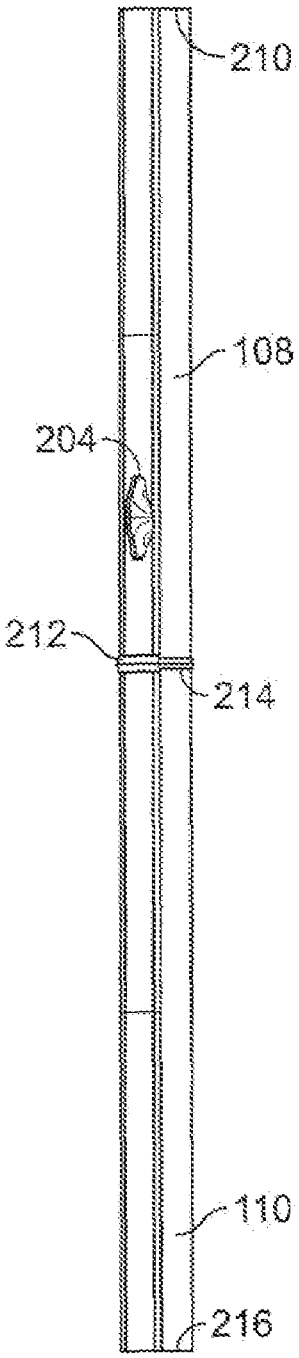
FIG. 2 shows the front of a line array assembly.

FIG. 2 shows line arrays 108 and 110. Each of line arrays 108 and 110 may have drivers, a section of which is shown in cut-away 204, disposed in substantially a line along the front of each array. One embodiment of each array may have, e.g., twelve drivers, and line array assembly 102 may thus comprise twenty-four drivers, each driver having a diameter, e.g. of less than three inches. The enclosure of each line array may be made from an aluminum extrusion, and the loudspeaker baffle may be a stamped aluminum part. Each loudspeaker baffle may also have a bass port in the center or other portion of the baffle. The extruded enclosure may be closed on both ends with injection molded plastic end caps 210, 212, 214, and 216. Each end cap may function to seal the acoustic enclosure by known methods, for example, by compression of a viscoelastic gasketing material. End cap 214 may house a mechanical locking mechanism, which along with bayonet 302 (FIG. 3) may function to secure line arrays 108 and 110 after assembly.

Figure 3:
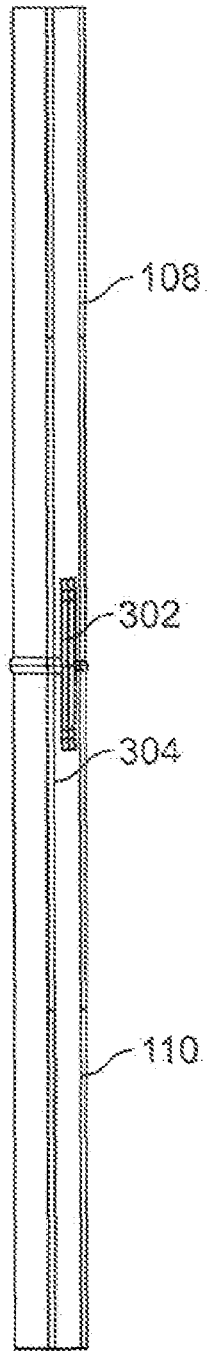
FIG. 3 shows the rear of a line array assembly.

FIG. 3 shows the rear of line array assembly 102. Bayonet 302 is a mechanical support which, in one embodiment, is permanently fixed to line array 108, which may mate to corresponding slot 304 along the back of line array 108. Alternatively, bayonet 302 may be fixed to line array 110 and may mate to a corresponding slot on line array 108. Bayonet 302 may help to align the line arrays for assembly and to firmly connect the line arrays to prevent relative motion during use. Bayonet 302 may be of any durable construction, and may be, for example, a two-piece-insert-molded construction having a formed thick steel inner support with a polyoxymethylene plastic outer shell in the shape of the corresponding slot on line array 110.

Figure 4:
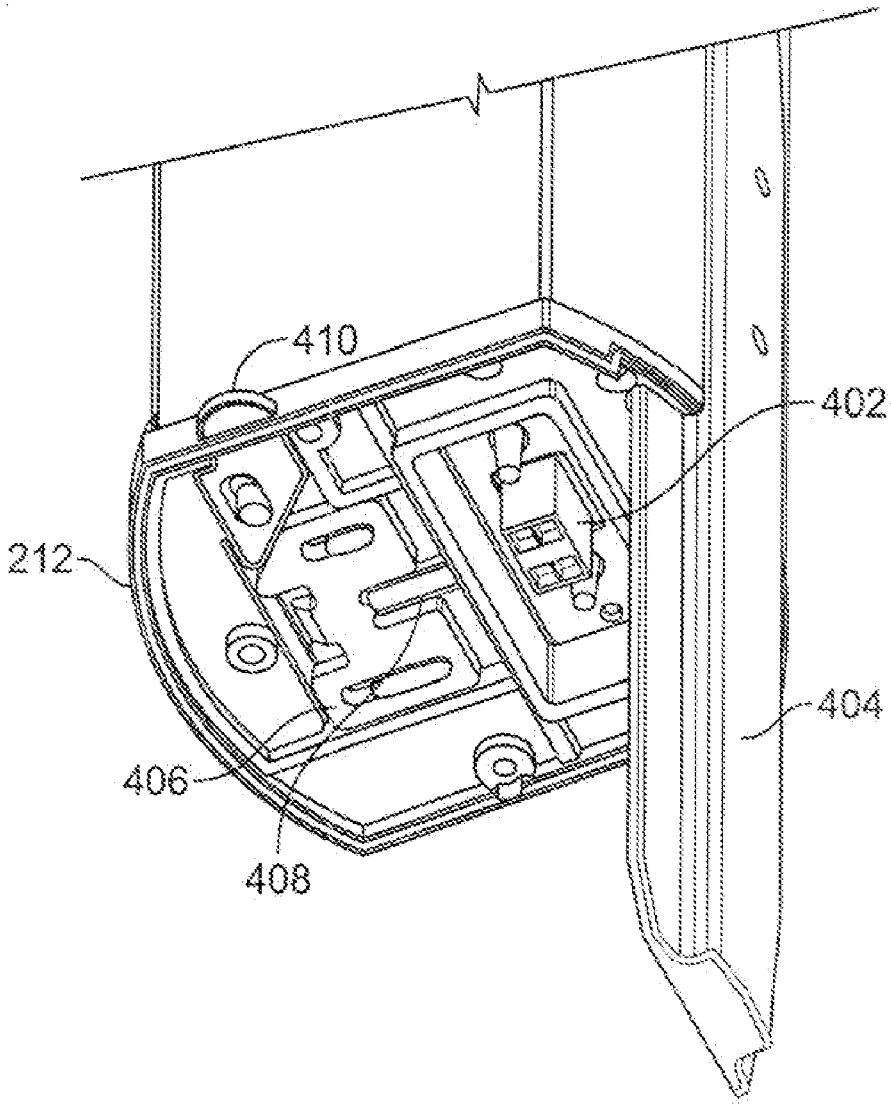
FIGS. 4, 5, 6 and 7 depict various end caps of line arrays.
Figure 5:
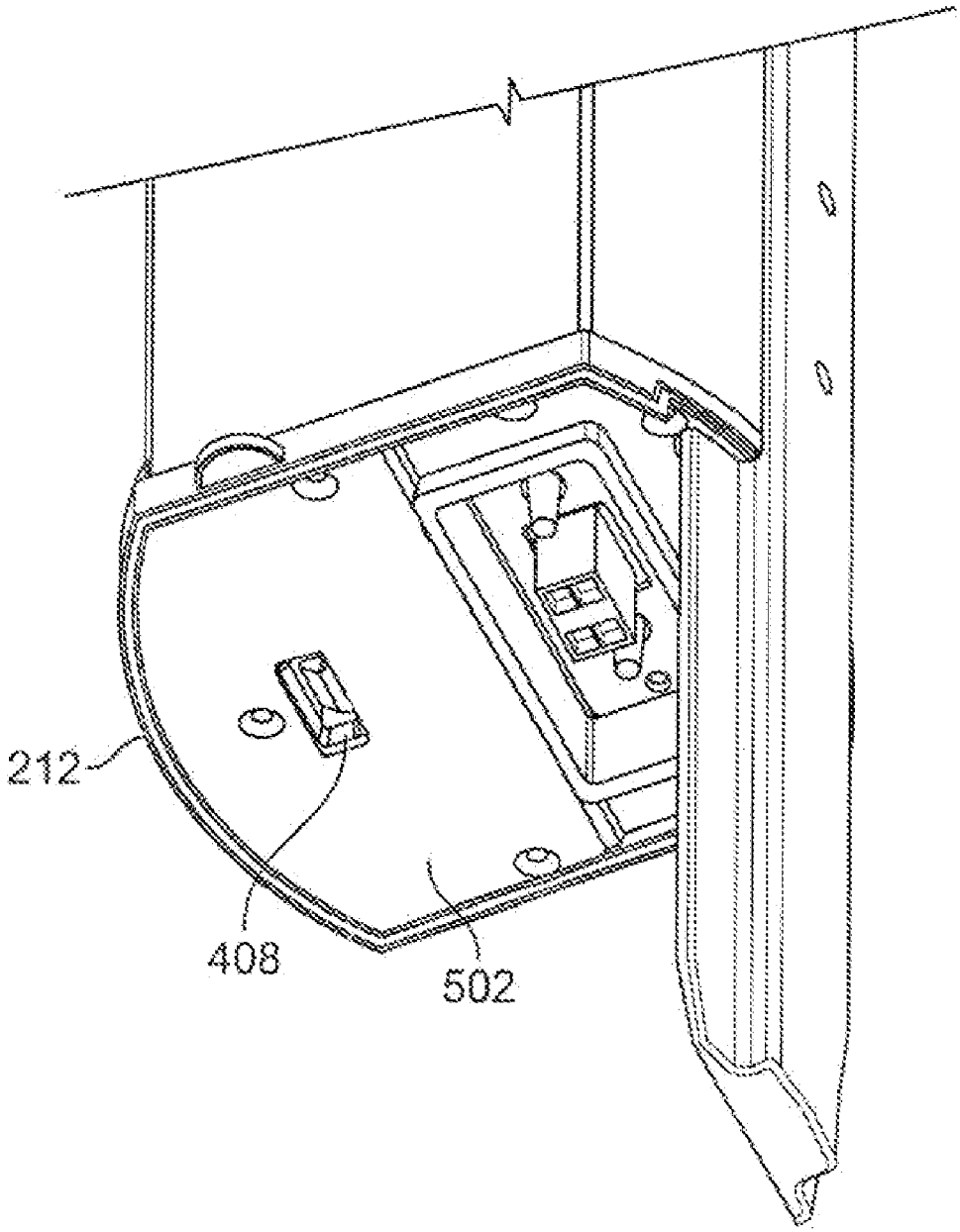
Figure 6:
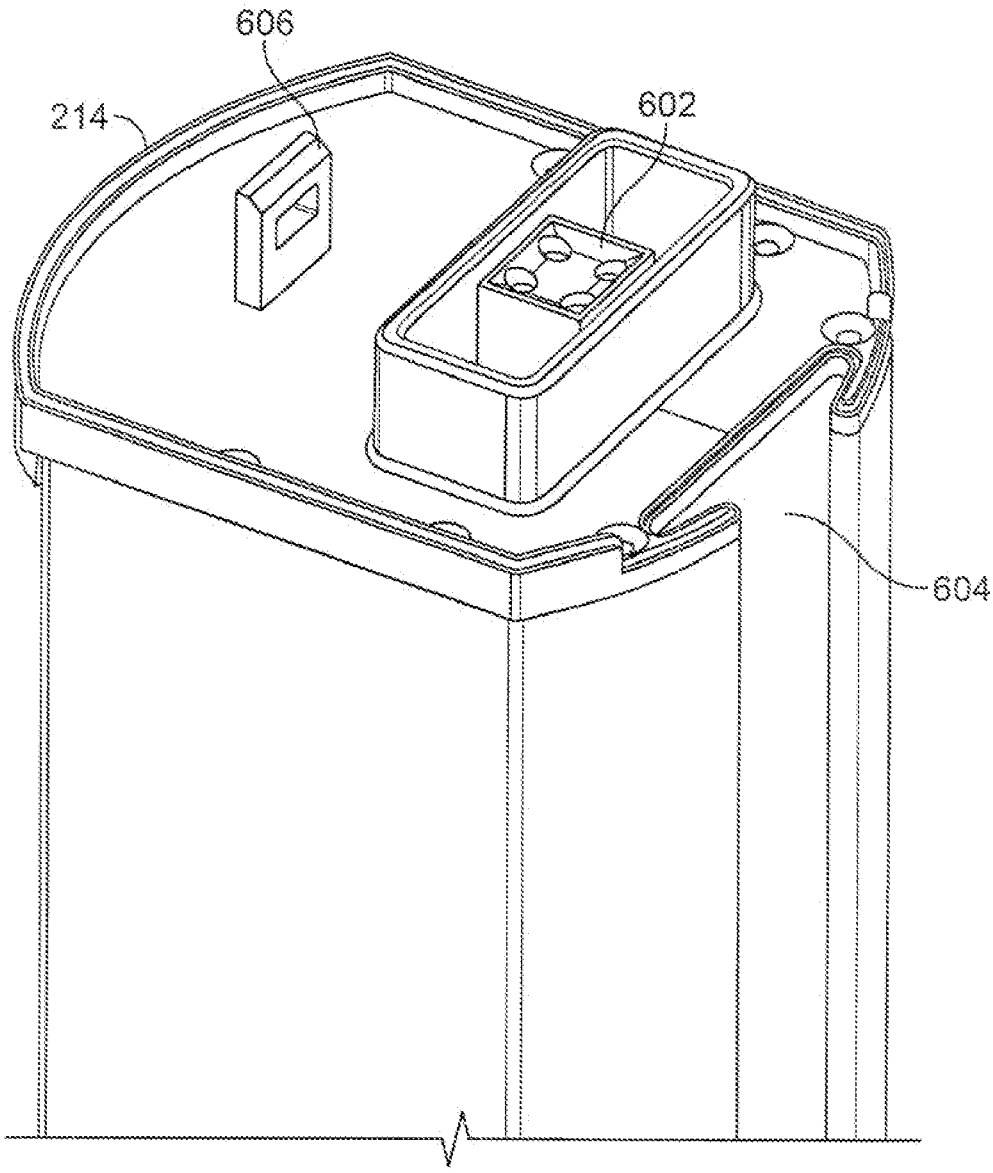
Figure 7:
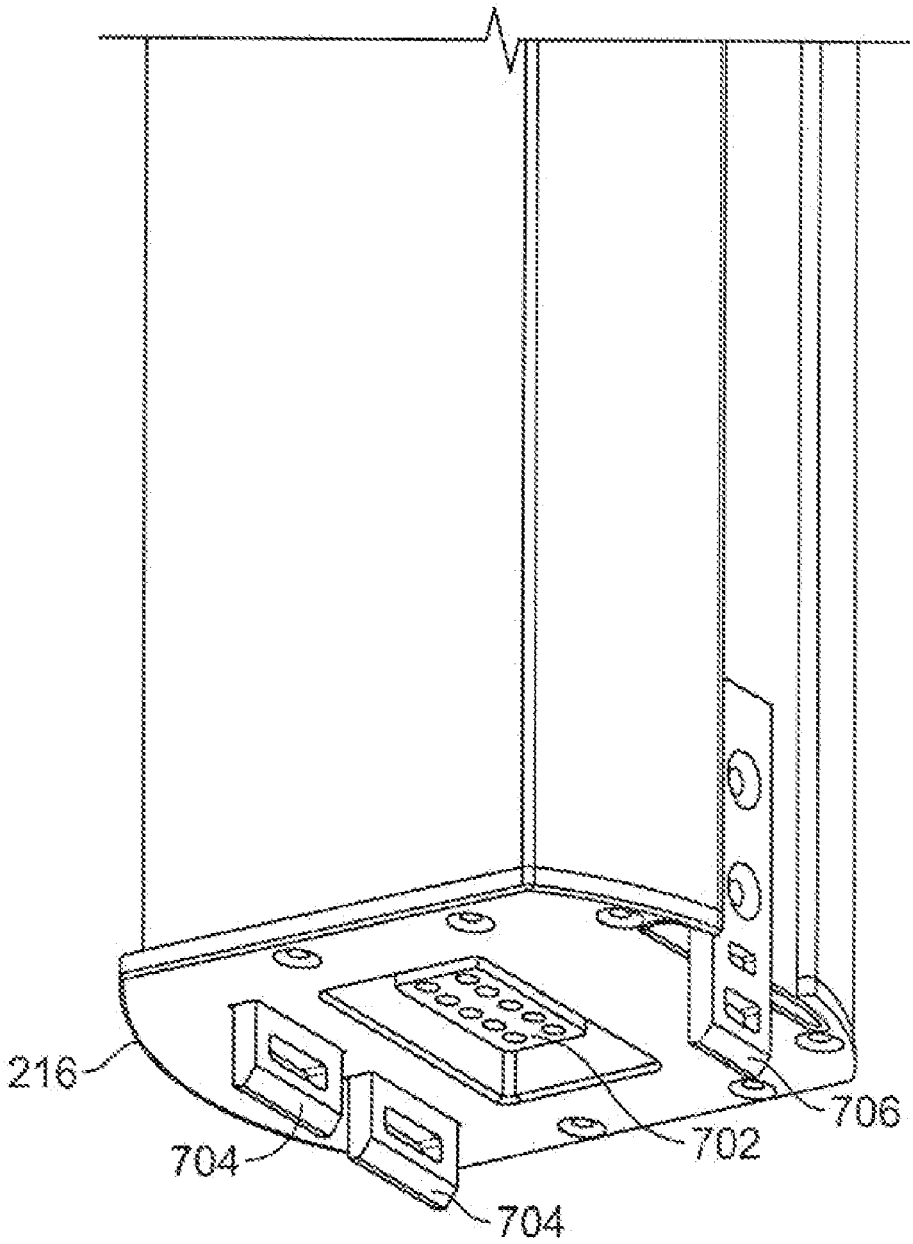
Figure 8:
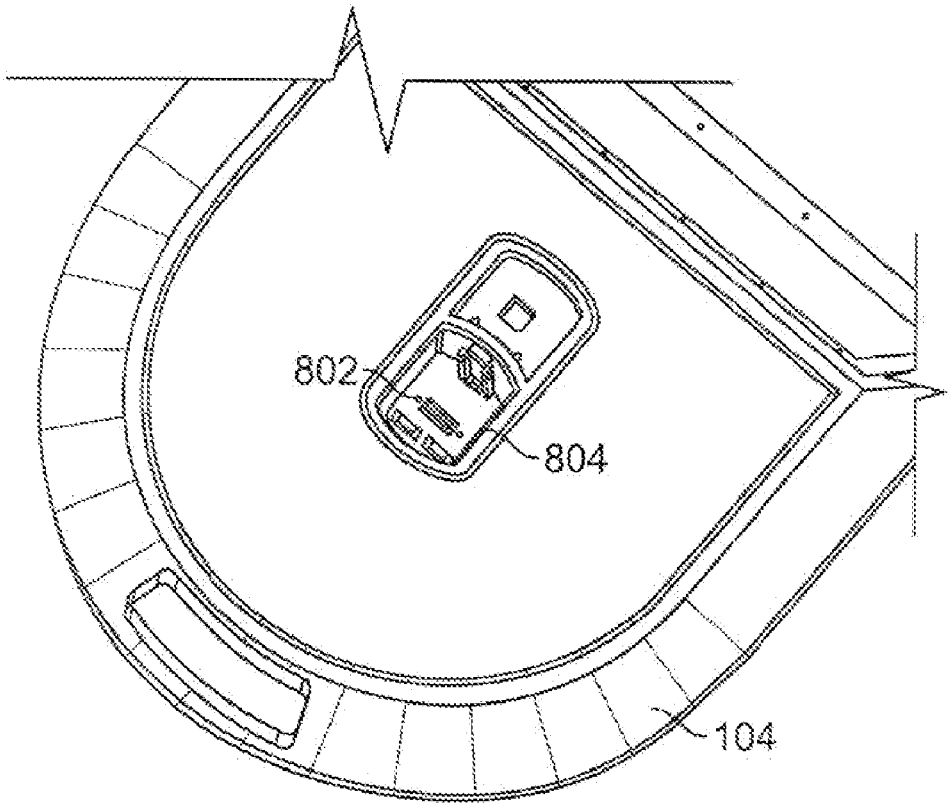
FIG. 8 shows an amplifier with a mechanical support and a mating connector.

Mating connectors may be used to permit the transmission of signals, which may be either electrical power (in AC or DC form) or information carrying signals (one example being an audio signal, as may be present at the output of an audio preamplifier or power amplifier), or both, from amplifier 104 to arrays 108 and 110. With reference to FIGS. 4-8, mating connectors may be disposed within end caps 212, 214 and 216, and within support 804. End caps 212 and 214 may have disposed within them mating connectors 402 and 602, while end cap 216 may have mating connector 702 which may mate with mating connector 802 disposed in support 804. Signals may thus be supplied from amplifier 104 to line array 110, and through line array 110 to line array 108. Mating connectors 402, 602, 702 and 802 may be self-aligning to assure proper connections are made when the system is assembled. One or both elements of mating connector pairs 402 and 602, or 702 and 802, may be relatively mobile to permit alignment for a connection to be made, and they may have mechanical features which permit the alignment of the connectors when components are assembled. FIG. 4 shows the disposition of connector 402 in end cap 212. When arrays 110 and 108 are assembled, connector 402 may mate with connector 602, shown in FIG. 6. The use of mating connectors to connect loudspeakers is not limited to a particular embodiment of the invention, and many types of components may be connected in this manner, including any type of speaker and any type of amplifier. The individual components so connected may be independent speakers or amplifiers, or they may be parts of a system that may require assembly to function.

To provide mechanical support to array 108, bayonet 404 may slide into slot 604, preventing relative motion during use. In addition, latch 606 may slide into slot 504 and may be secured by locking mechanism 406, an embodiment of which is shown in FIG. 4. Locking latch 406 is provided with pressure by spring 408, and may secure latch 606 when arrays 108 and 110 are assembled. For disassembly, release button 410 is provided along the exterior of end cap 212, which, when depressed, provides mechanical force against spring 408 to release latch 406.

Structure 502, which may be, for example, a steel plate or any structure of sufficiently durable construction, secures components 406, 408 and 410 of the locking mechanism. As end caps 212 and 214 are separated, mating connectors 402 and 602 may disengage.

Figure 9:
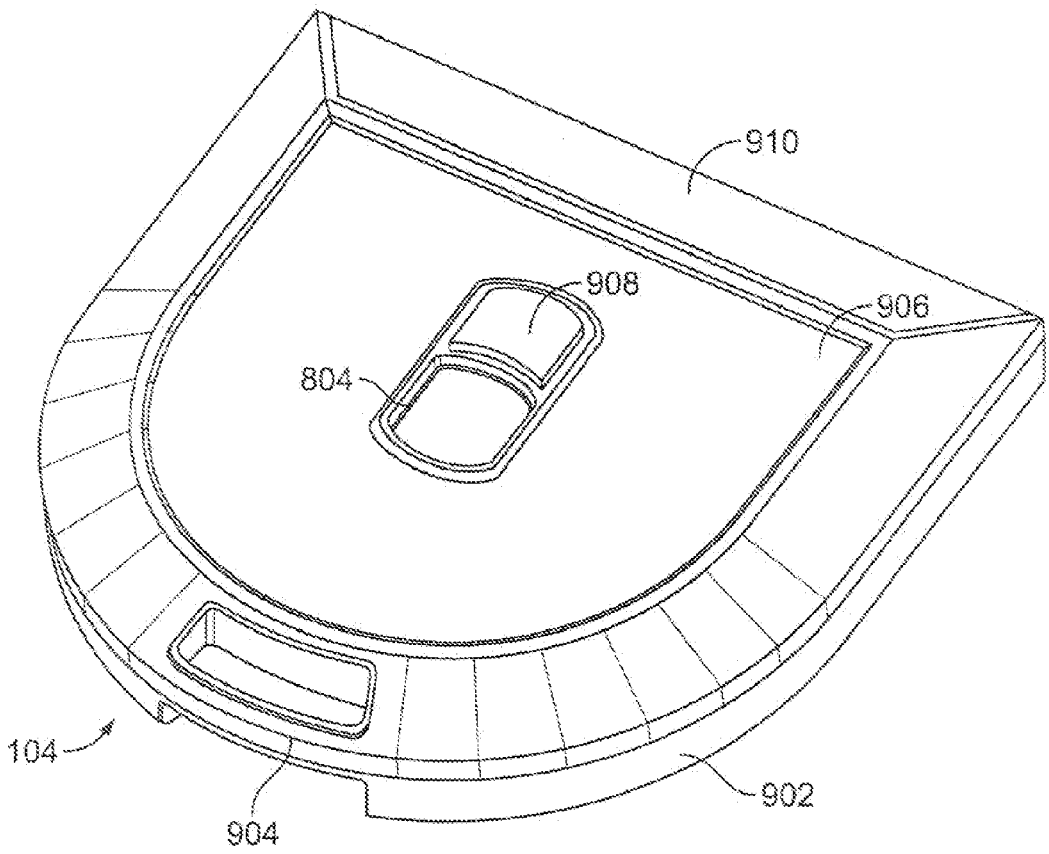
FIG. 9 shows one embodiment of an amplifier in accordance with the present invention.

FIG. 9 shows an embodiment of amplifier 104, which comprises an enclosure 902, having an upper half and a lower half. The enclosure halves may be of durable construction, such as injection-molded plastic housings. Enclosure 902 may also have a molded handle 904 to permit carrying during transport. The underside of the lower half may have elements that act as feet (not shown). The upper half may have a formed depression 906, which may serve a number of functions, for example, the capture of spilled liquids. In one embodiment, depression 906 may hold up to one imperial pint of liquid.

The upper half of enclosure 902 may have an integral mechanical support 804 which may mate with the lower portion of array 110. Mechanical support 804 may also have mating connector 802 within which may mate with connector 702 in end cap 216. Mechanical support 804 should be of sufficient durability to support line array assembly 102, such as, for example, an aluminum die-cast structure. Disposed within enclosure 902 may be a locking mechanism which may secure line array 110 when it is fitted into mechanical support 804. The upper half of enclosure 902 may also have foot-operated treadle 908 which may mechanically release the locking mechanism to permit the removal of line array 110.

Figure 10:
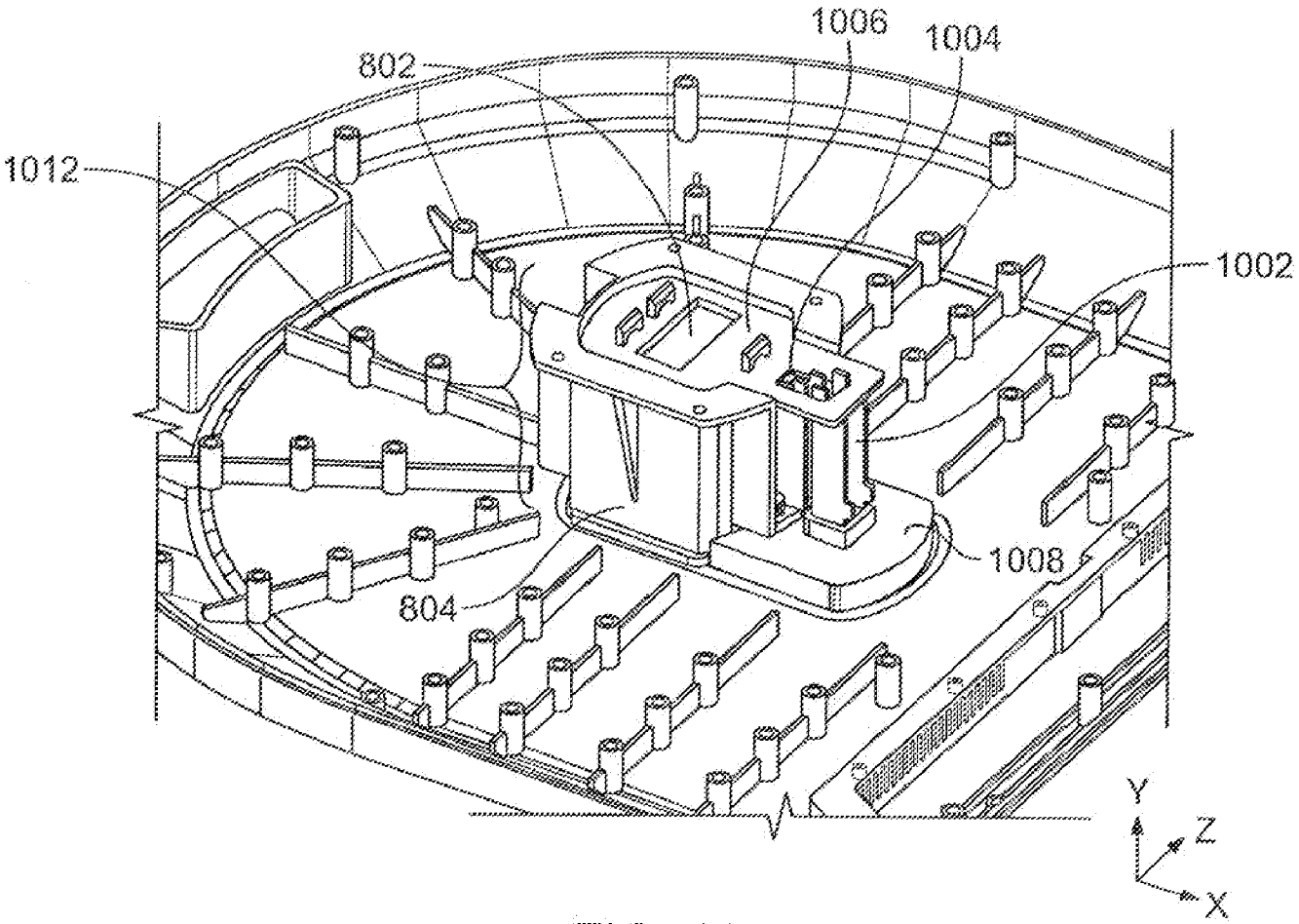
FIG. 10 shows an embodiment of a locking mechanism which may be disposed within the amplifier.

FIG. 10 shows an interior view of the top half of enclosure 902, showing mechanical support 804 and connector 802 (with internal electrical connections not shown). Locking assembly 1012, comprising slide 1002, spring 1004 and locking latch 1006 is disposed within amplifier enclosure 104 such that slide 1002 passes through pocket 1008 to communicate at one end with treadle 908. Slide 1002 is in communication with locking latch 1006 at its opposite end. Spring 1004 provides sufficient force to locking latch 1006 to capture latches 704 and 706 as end cap 216 is inserted into mechanical support 804. Mechanical support 802 is secured to the inner surface of the lower half of enclosure 902, thus securing locking assembly 1012 within enclosure 902.

Mating connector 702 is disposed within end cap 216, and may mate with connector 802 to permit the transmission of signals from amplifier 104 to array 110. Signals may be any signals which may be transmitted from amplifier 104 to array 110, e.g. the output of a power amplifier, or DC or AC power. When end cap 216 is inserted into mechanical support 804, connectors 702 and 802 may self-align. Additionally, to mechanically secure array 110 within mechanical support 804, latches 704 and 706 may be secured by locking latch 1006. The interior surfaces of enclosure 902 may provide sufficient structure to secure the components of locking assembly 440.

For disassembly, treadle 908 is provided along the outer surface of the upper half of enclosure 902, which, when depressed, provides mechanical force to slide 1002. Slide 1002 in turn translates force to locking latch 1006, which works against spring 1004 to release latches 704 and 706. As end cap 216 is removed from mechanical support 406, mating connectors 702 and 802 may disengage.

Figure 11:
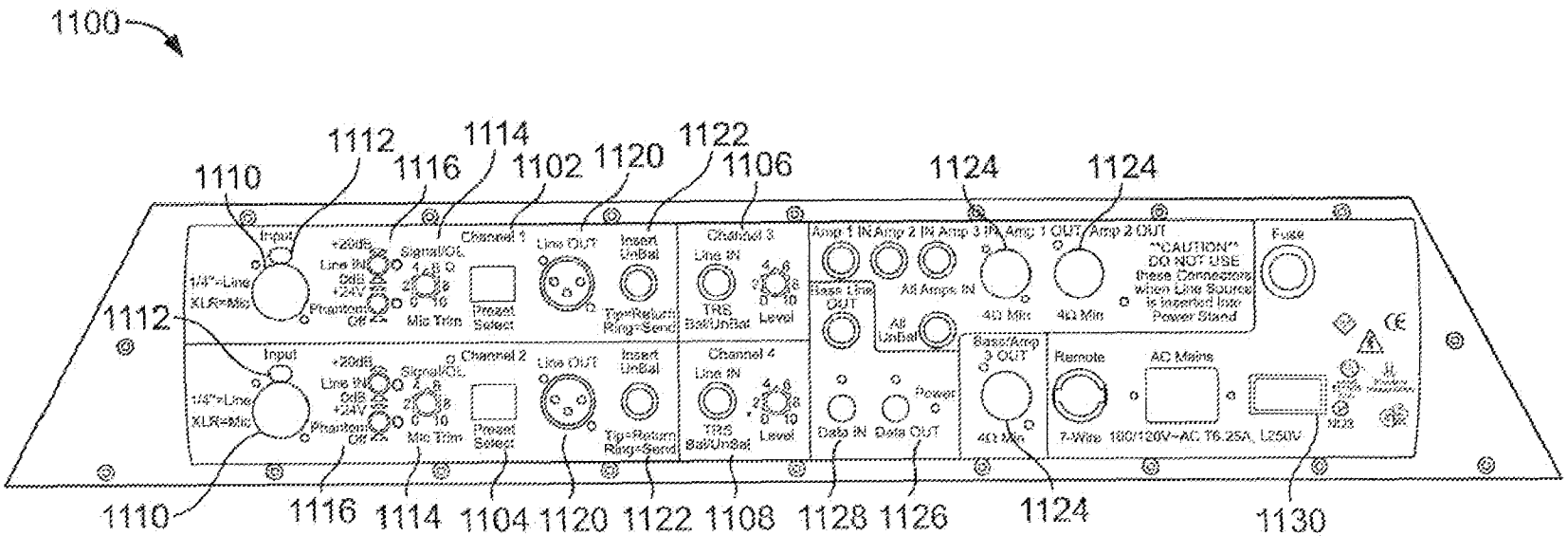
FIG. 11 illustrates an embodiment of a rear panel on the amplifier.
Figure 12A:
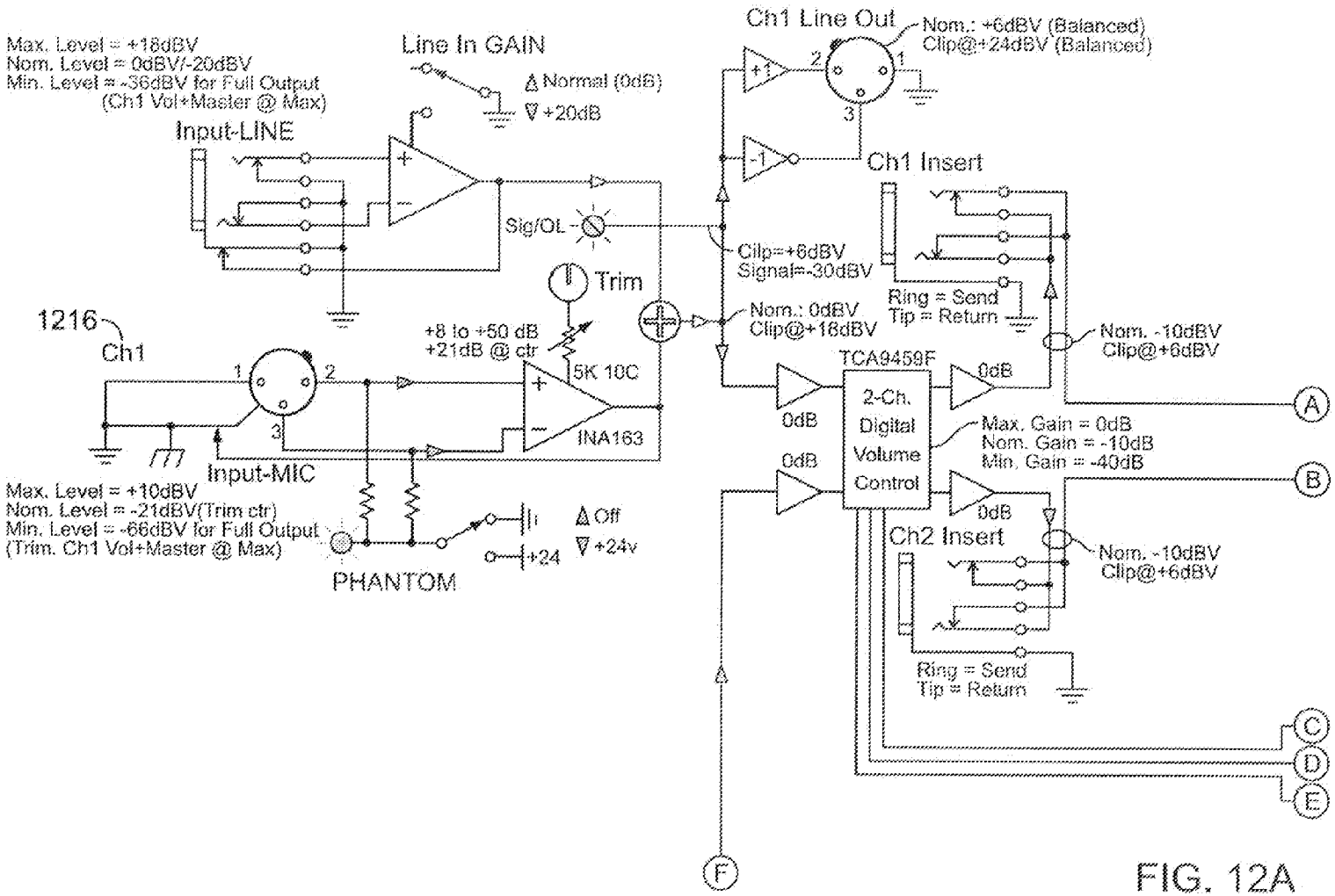
FIG. 12 shows a block circuit diagram of the system.
Figure 12B:
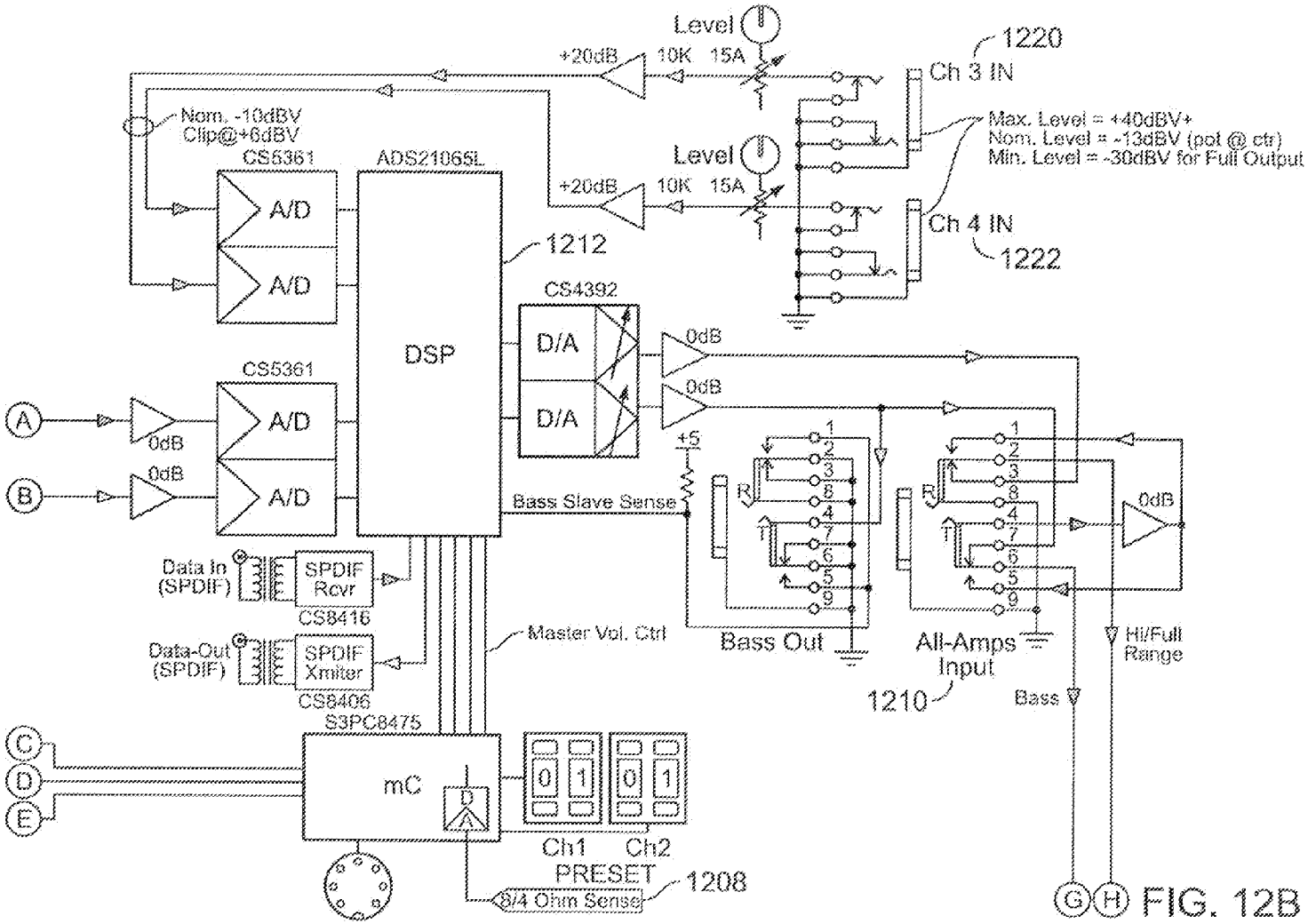
Figure 12C:
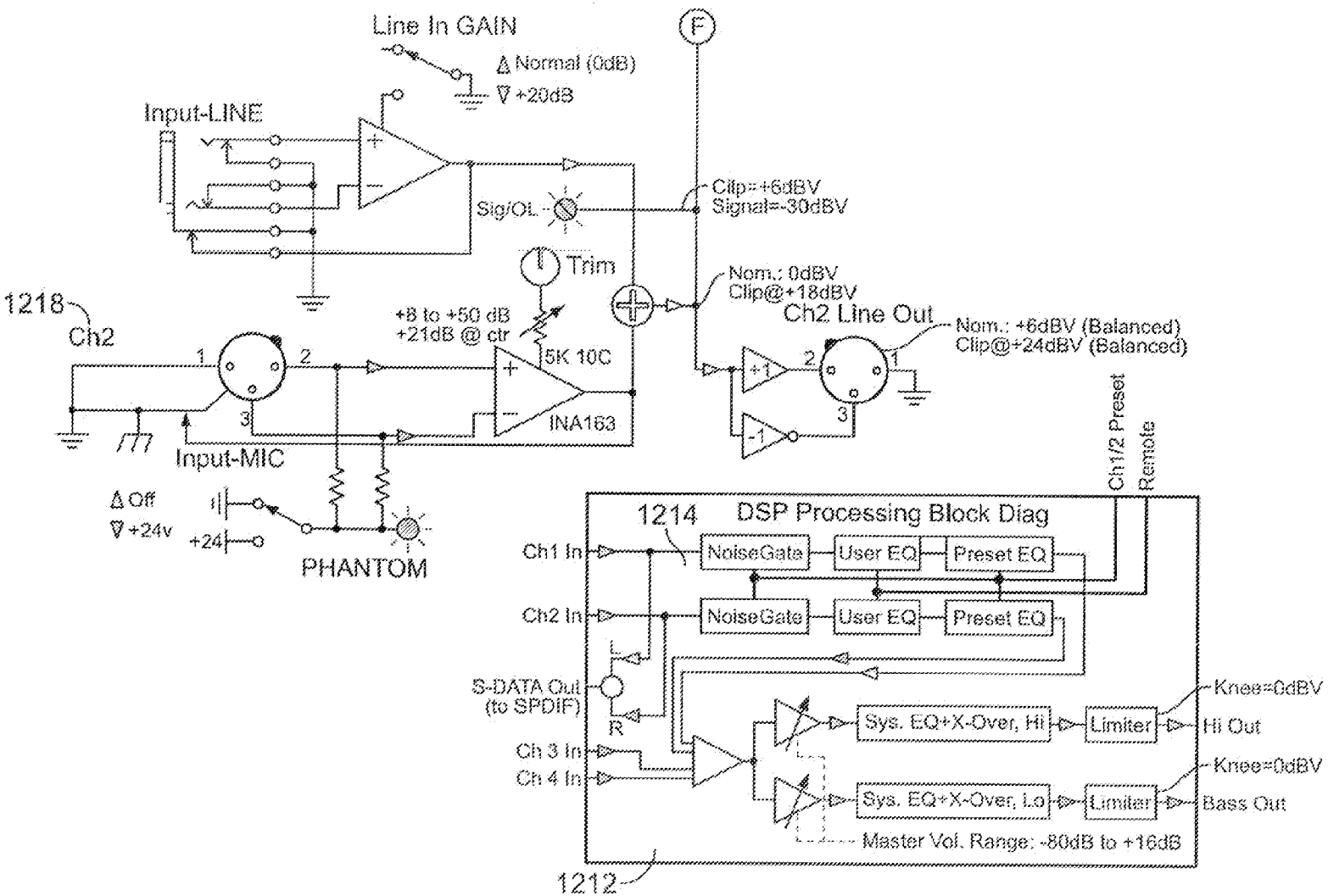
Figure 12D:
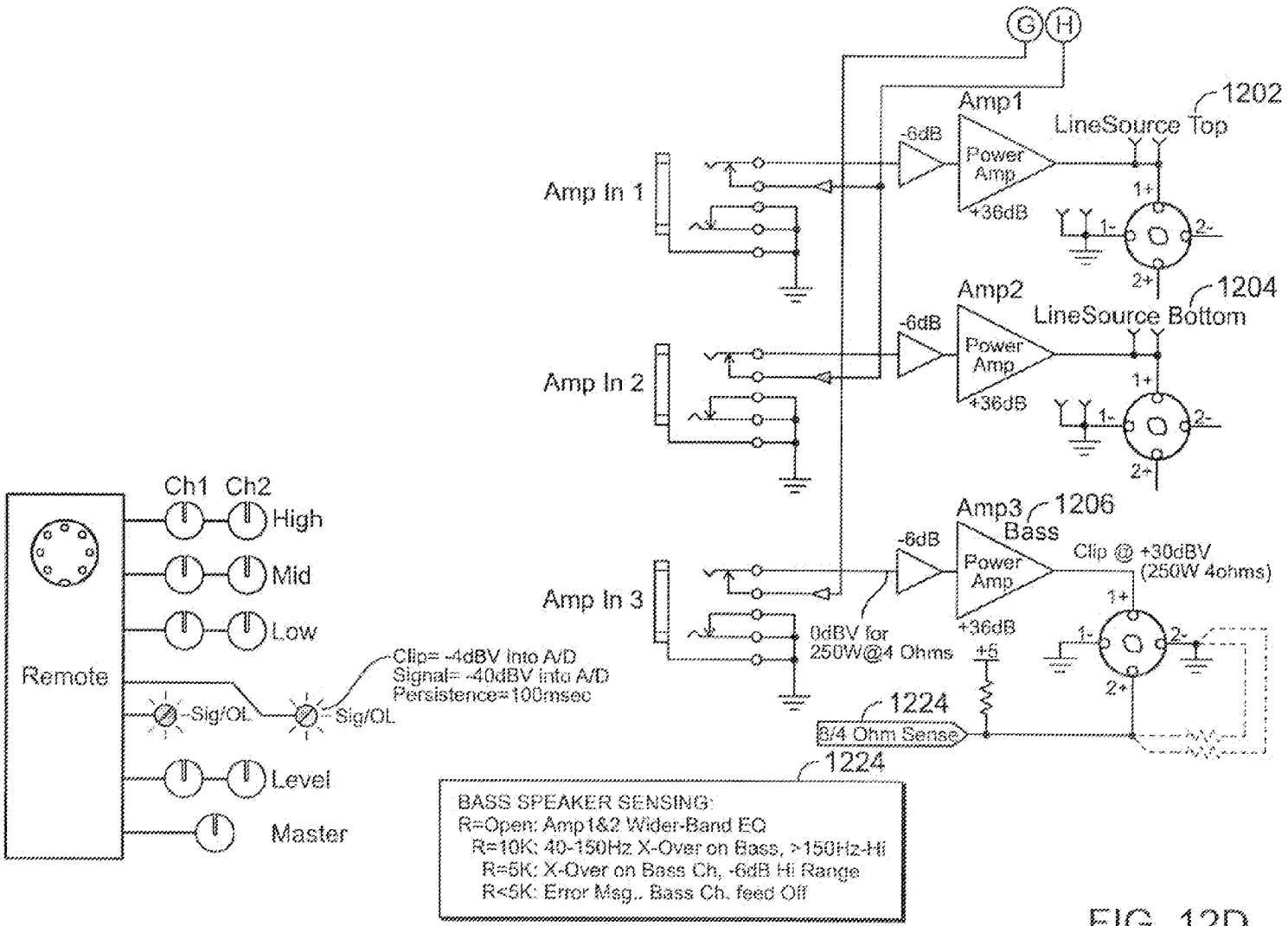

FIG. 9 shows rear panel 910, which may be hinged along the rear of enclosure 902, to cover and protect input/output panel 1100. FIG. 11 shows input/output panel 1100, which generally comprises controls and input/output ports disposed along the rear of enclosure 902. Signal inputs may be provided to permit the introduction of signals into the system. In one embodiment, four channels of internally mixable signal inputs 1102, 1104, 1106, and 1108 are provided, however, use of more or fewer channels is also contemplated. Signals may be introduced from any type of signal source, which may be a microphone, or a musical instrument, or any other digital or analog audio source. Channels 1102 and 1104 may have an XLR connector jack 1110 and a ¼" TRS connectorjack 1112. Signals received at each of these jacks may be handled differently by the system, eliminating the need for a "mic/line" switch. For example, if a ¼" TRS connector is inserted into input 1112, a signal may be sent to a line-level mixing circuit; however, if an XLR male connector is inserted into input 1110, its signal may be sent to, for example, a high-quality microphone preamplifier with "trim" or level control 1114, and may then be internally mixed. Additional controls 1116 may permit a user to select "phantom" power for use of the system with condenser and electret microphones. Indicators such as LED lights may be included to indicate both phantom "on" and signal present/signal overload conditions.

The configuration of channels 1102 and 1104 may vary in embodiments to permit expanded functionality. In one embodiment, channels 1102 and 1104 may have separate, buffered, full-range XLRM outputs 1120, to permit signals from channel 1102 or 1104 to be sent for direct recording. Channels 1102 and 1104 may also allow a user to patch typical outboard signal processing into the signal path through patch point 1122, e.g., to include desired effects such as delay or reverberation. Alternatively, a channel may have simply one type of connector, as for example with channels 1106 and 1108, which are depicted with only standard TRS jacks.

I/O panel 1100 may also provide power amplifier outputs 1124 for the power amplifiers. Outputs 1124 may permit connections to be made in a number of known ways, such as providing for Neutrik NL4 Speakon connectors. If line array assembly 102 is assembled with amplifier 104, power amplifiers may be used to drive the line array assembly; in one embodiment, some of power amplifier outputs 1124 may be temporarily disabled in such case. I/O panel 1100 may also include additional I/O ports. A "data out" channel 1126 may be provided to permit, for example, two-channel digital recording from the system. A "data in" channel 1128 may be provided to permit, for example, a means of updating system software. The I/O ports may be of known data jack formats, such as SPDIF, USB or EEE 1394. I/O panel 1100 may also include a power switch 1130 and an LED or similar indicator to indicate that power is provided to the system.

In one embodiment, depicted in FIG. 12, amplifier 104 may contain three lightweight switching power amplifiers 1202, 1204, and 1206. When line array assembly 102 is not attached to amplifier 104 (which may be detected by some known electrical means, e.g. detection of an expected level of impedence 1208), amplifier 104 may be used as an auxiliary three-channel amplifier. Any analog or digital signal source may be used to introduce signals to amplifier 104 in such case. The power amplifiers may be used independently or with a specific common input 1210 which distributes any signal to all three power amplifiers. With the line array assembly attached, amplifiers 1202 and 1204 may be employed to drive the two line arrays. The remaining power amplifier 1206 may be used for any purpose, such as to drive an additional speaker, for example a peripheral bass module. This feature may permit a user with a means to, for example, drive additional bass modules connected with the system if more bass level is desired in a particular performance environment (such as with electronic drums, a disco or hip-hop musical playback, for use with bass guitar, and the like). Additionally, the power amplifiers may be for particular system requirements or configurations, such as, in one embodiment, for a 4 ohm load.

Signal processing element 1212, which is a digital signal processor in one embodiment, may be included in the system to provide any number of audio signal processing capabilities, for example, electronic crossover filters for high and low frequency system components, room equalization to compensate for the acoustics of a particular room or other space, voltage limiting for prevention of damage to the system due to excessive input levels, volume adjustment and noise gating.

In one embodiment, channels 1102 and 1104 may include user-selectable presets 1214 having settings for, e.g., equalization filter parameters and noise-gate parameters. Examples of equalization filter parameters may be corner frequency (for low pass high pass, or all pass type filters), filter order, filter type (i.e., Bessel, Butterworth.) center frequency (for bandpass or band stop type filters), Q and gain. Other types of parameters for other filter types not explicitly mentioned are also contemplated, such as pole and zero real and imaginary parts, or frequencies and Q. Examples of noise gate parameters may be threshold, attack time, release time and gain. Presets 1214 may be determined for particular combinations of known equipment, such as microphones, musical instruments or sound processing equipment. For example, a preset may have a setting for an electric guitar that cuts signals above 5 KHz, and below 80 Hz. Other presets may be for combinations of specific instrument, microphone, and speaker, such as a Martin D45 acoustic guitar with an AKG 414 microphone at the sound hole, and a Shure Beta 58 used with the line array assembly. Other presets may be for combinations of specific instruments and speakers. Other possible presets include dynamic equalization, dynamic range processing, or any other known audio signal processing which may be varied. Examples of dymanic equalization parameters may be center frequency of equalization, and amount of boost applied as a function of signal level. Examples of dynamic range parameters may be amount of compression, thresholds for when compression occurs, attack and release times, or any other known adjustable parameter. Additionally, noise gate parameters may be defeatable so that a user may disable the feature as desired. On the other hand, channels 1106 and 1108, corresponding to inputs 1220 and 1222 may, for example, accept line level signals via TRS ¼" connectors, and may be directed into the system with no preset equalization. Presets may be modified by a user, and may be transferred into and out of the system through I/O data ports 1126 and 1128. This feature may permit users share modified presets.

In the embodiment described above, the four inputs may permit a singer or instrumentalist to amplify a wide variety of musical, speech or recorded signals without additional equipment. If a performer desires more inputs or more comprehensive signal processing, a known mixer or signal processing equipment may be inserted into a channel or mixed via any of the four inputs.

Figure 13:
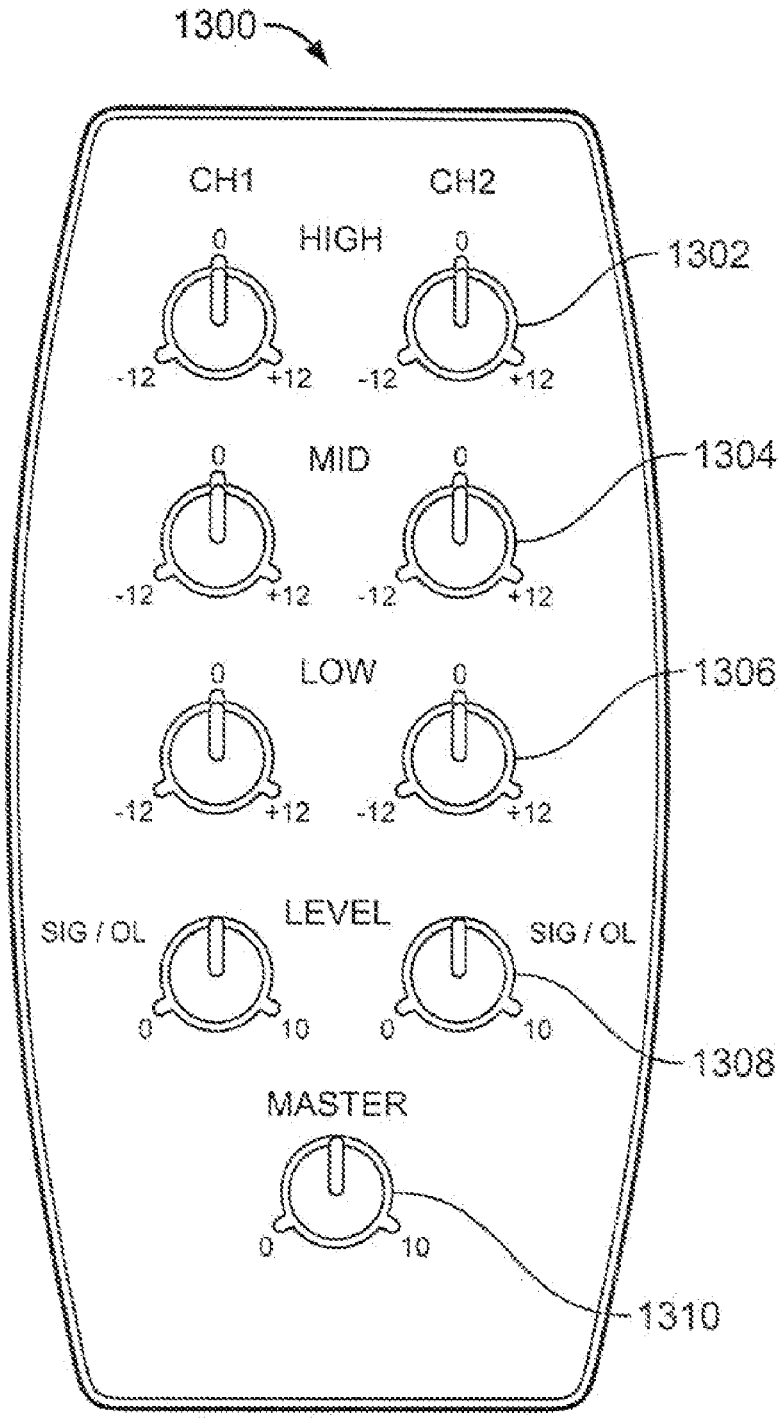
FIG. 13 depicts a remote control which may be used with the system.

Remote control 1300 may be provided with the system, an example of which is depicted in FIG. 13. Remote control 1300 may comprise electronics and controllers to permit a user to control and modify amplifier and channel settings, for example, to permit a user to adjust the system for specific performance locations. The remote may communicate with amplifier 104 by means of a physical connection, such as a 5 pin DIN/MIDI connector/cable assembly, or through a wireless means, such as IR or radio transmission. Features of remote 1300 may also include controllers to permit the adjustment of any system setting, e.g., channel level, high-, mid- and low-frequency equalization controls 1302, 1304 and 1306, channel clip/signal present 2-color LED 1306, and a master level control 1310. Controls may also be provided which permit adjustment or selection of presets or any other system parameters.

As described above, the system may also permit use with a bass module. An example of a suitable bass unit is the Panaray® MB4 modular bass loudspeaker available from Bose Corporation. In an embodiment, one or two bass modules may be connected with amplifier 104 and used with system 100. In an embodiment, total system bass output may be limited in the case of the use of a single bass module, and may require line array assembly 102 to be operated at approximately 6 dB lower output to match the bass output. Such output matching may be performed automatically, triggered by electrical sensing 1224 of bass modules connected to amplifier 104 similar to the sensing of the line array assembly. The limiting threshold for the system may change depending on the number of sensed bass modules. For example, the limiting threshold may be set lower if one bass module is detected, and may be increased if two bass modules are detected. Bass modules may communicate with amplifier 104 in any number of known ways, for example, via a Neutrik NL4/Speakon connector.

There has been described novel apparatus and techniques for linear array electroacoustical transducing. It is evident that those skilled in the art may now make numerous uses and modifications of and departures from the specific apparatus and techniques herein described without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. A loudspeaker system, comprising:

a line array assembly, comprising at least two line arrays; and an amplifier;

said line array assembly having a first mechanical support, fixed to one of said at least two line arrays, which may be fitted to another of said at least two line arrays, to prevent relative motion when assembled;

said line arrays having line array mating connectors, to permit the introduction of signals to one of said at least two arrays from said amplifier, and to further permit transmission of signals among said line arrays;

said amplifier having a second mechanical support, to which said line array assembly may be fitted, to support said line array assembly;

said second mechanical support having an amplifier mating connector, capable of mating with one line array mating connector when said line array assembly is fitted to said second mechanical support, to permit the transmission of signals to said line array assembly.

2. The loudspeaker system of claim 1, wherein said line array mating connectors self-align when said line array assembly is assembled.

3. The loudspeaker system of claim 1, wherein said amplifier mating connector may self-align with one of said line array mating connectors when said line array assembly is fitted to said second mechanical support.

4. The loudspeaker system of claim 1, wherein said line array assembly further comprises a first locking mechanism, to secure said at least two line arrays when assembled.

5. The loudspeaker system of claim 1, wherein said second mechanical support further comprises a second locking mechanism, to secure said line array assembly to said second mechanical support.

6. The loudspeaker of claim 1, wherein said amplifier further includes signal processing means, for processing of signals input to said amplifier.

7. The loudspeaker system of claim 6, wherein said signal processing means further comprises one of:

electronic crossover filters for high and low frequency system components, equalization, voltage limiting, dynamic range processing, dynamic equalization, volume and, noise gating.

8. The loudspeaker system of claim 6, wherein said signal processing means further comprises the application of preset processing parameters.

9. The loudspeaker system of claim 8, wherein said preset processing parameters arc selectable by a user.

10. The loudspeaker system of claim 8, wherein said preset processing parameters are equalization filter parameters or noise-gate parameters.

11. The loudspeaker system of claim 8, wherein said preset processing parameters are determined for specific combinations of microphones, musical instruments, speakers or sound processing equipment.

12. The loudspeaker system of claim 8, wherein said preset processing parameters may be modified by a user.

13. The loudspeaker system of claim 8, wherein said preset processing parameters may be disabled by a user.

14. The loudspeaker system of claim 1, wherein said amplifier has a formed depression, capable of capturing liquid.

15. The loudspeaker system of claim 1, further comprising a first detection means, wherein, when said line array assembly is fitted to said second mechanical support, a connection between said amplifier mating connector and one of said line array connectors is detected by said first detection means, to permit modification or said signals for output to said at least two line arrays.

16. The loudspeaker system of claim 1, further comprising a second detection means, wherein, when said line array assembly is fitted to said second mechanical support, a connection between said line array mating connectors on said at least two line arrays is detected by said second detection means, to permit modification or said signals for output to said at least two line arrays.

17. The loudspeaker system or claim 7, further comprising a remote control, to permit the remote adjustment of parameters associated with said signal processing.

18. The loudspeaker system of claim 1, wherein said amplifier has three power amplifiers, and wherein, when said line array assembly is fitted to said second mechanical support, two of said three power amplifiers supply signal to said line array assembly.

19. The loudspeaker system of claim 1, wherein power may be transmitted from said amplifier to said line array assembly.

20. The loudspeaker system of claim 1, further comprising at least one bass module, in communication with said amplifier.

21. The loudspeaker system of claim 1, wherein said amplifier further comprises a plurality of input channels, to permit the input of signals into the system for amplification.

22. The loudspeaker system of claim 21, wherein said amplifier further comprises a signal processing means, permitting the receipt of said signals front said input channels, and to permit the processing and output of said signals.

23. The loudspeaker system of claim 22, wherein said amplifier further comprises at least one power amplifier, to receive said signals from said signal processing means and to amplify and output said signals to said at least two line arrays.

24. The loudspeaker system of claim 23, wherein said amplifier further comprises a microprocessor, to control the operation of said input channels, said signal processing means, and said at least one power amplifier.

25. The loudspeaker system of claim 23, wherein said amplifier further comprises a power amplifier output channel, to permit the output of signals from said at least one power amplifier to an auxiliary output destination.

26. The loudspeaker system of claim 25, wherein said power amplifier output channel is disabled when said line array assent assembly is fitted to said second mechanical support.

27. A loudspeaker system, comprising:

a line array assembly, comprising at least two line arrays;

an amplifier; and at least one input device, in communication with said amplifier;

said line array assembly having a first mechanical support, fixed to one of said at least two line arrays which may be fitted to another of said at least two line arrays, to prevent relative motion when assembled;

said line arrays having line array mating connectors, to permit the introduction of signals to one of said at least two arrays from said amplifier, and to further permit transmission of signals among said line arrays;

said amplifier having a second mechanical support, to which said line array assembly may be fitted, to support said line array assembly;

said second mechanical support having an amplifier mating connector, capable of mating with one line array mating connector when said line array assembly is fitted to said second mechanical support, to permit the transmission of signals to said line array assembly.

28. The loudspeaker system of claim 27, wherein said at least one input device is a microphone, a musical instrument, a digital source, or an analog source.

29. The loudspeaker system of claim 27, further comprising in at least one bass module, in communication with said amplifier.

30. The loudspeaker system of claim 27, wherein said amplifier further comprises a plurality of input channels, to permit the input of signals into the system for amplification.

31. The loudspeaker system of claim 30, wherein said amplifier further comprises a signal processing means, permitting the receipt of said signals from said input channels, and the processing and output of said signals.

32. The loudspeaker system of claim 31, wherein said amplifier further comprises at least one power amplifier, to receive said signals from said signal processing means and to amplify and output said signals to said at least two line arrays.

33. The loudspeaker system of claim 32, wherein said amplifier further comprises a microprocessor, to control the operation of said input channels, said signal processing means, and said at least one power amplifier.

34. A loudspeaker system, comprising:

a line array assembly, comprising a first array and a second array; and an amplifier;

said first array having a fixed mechanical support, which may be fitted to said second array, to prevent relative motion when assembled;

said first array having a locking mechanism, to secure said first and second arrays together when assembled;

said first and second arrays having first mating connectors, which, when said assembly is assembled, permit the communication of signals between said first and second arrays;

said amplifier having a mechanical support means to which said second array may be fitted, to support said second array;

said mechanical support having a locking mechanism, to secure said line array assembly to said amplifier;

said second array having a second mating connector, to permit the communication of power and signals from said amplifier to said second array;

said mechanical support means having a mating connector, which may mate with said second mating connector, to permit the transmission of signal to said second array;

said amplifier having at least one power amplifier, to drive said line array assembly;

said amplifier having input channels, to permit the input of signals into the system for amplification.

35. The loudspeaker system of claim 34, wherein said amplifier further comprises a signal processing means, permitting the processing of signals which are input into the system.

36. The loudspeaker system, of claim 34, wherein said amplifier is configured to serve as a base for said line array assembly.

* * * * *